US009084309B2

(12) United States Patent
Khayat et al.

(10) Patent No.: US 9,084,309 B2
(45) Date of Patent: Jul. 14, 2015

(54) DIGITAL PHASE ANGLE DETECTION AND PROCESSING

(75) Inventors: Joseph Maurice Khayat, Bedford, NH (US); Geoffrey Potter, New Castle, NH (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 653 days.

(21) Appl. No.: 13/479,038

(22) Filed: May 23, 2012

(65) Prior Publication Data

US 2013/0314002 A1 Nov. 28, 2013

(51) Int. Cl.
*H05B 37/02* (2006.01)

(52) U.S. Cl.
CPC ..... *H05B 37/0227* (2013.01)

(58) Field of Classification Search
None
See application file for complete search history.

(56) References Cited

U.S. PATENT DOCUMENTS

| | | | | |
|---|---|---|---|---|
| 8,664,886 | B2 * | 3/2014 | Ostrovsky | 315/291 |
| 2010/0060202 | A1 | 3/2010 | Melanson et al. | |
| 2011/0193494 | A1 * | 8/2011 | Gaknoki et al. | 315/297 |
| 2012/0146540 | A1 * | 6/2012 | Khayat et al. | 315/291 |

* cited by examiner

*Primary Examiner* — Cassandra Cox
(74) *Attorney, Agent, or Firm* — William B. Kempler; Frank D. Cimino

(57) ABSTRACT

Apparatus and methods operate to perform digital time sampling of a waveform associated with a rectified alternating current, edge-controlled power signal, whether leading or trailing edge-controlled. A dimming code (DIM code) is generated based upon rising and falling edge zero crossing timing. The DIM code is normalized with respect to an allowable edge control window synchronized with the waveform. A minimally-dimmed waveform results in a maximum DIM code corresponding to a full-scale DAC maximum brightness analog output signal. The DIM code is loaded into a DAC to be converted to an analog brightness signal. The analog brightness signal may be used by a lighting power controller to control the brightness of one or more lighting elements. Accurate and repeatable light intensities independent of dimmer type may result.

20 Claims, 4 Drawing Sheets

DIGITAL PHASE ANGLE DETECTION AND PROCESSING

TECHNICAL FIELD

Embodiments described herein relate to apparatus and methods associated with electronic circuits, including digitally processing a dimmer signal to obtain a normalized digital representation of a lighting brightness signal.

BACKGROUND INFORMATION

A bidirectional triode thyristor is commonly referred to as a triode for alternating current (AC) or "TRIAC." A TRIAC is a three-terminal electronic component that can conduct current in either direction via a current channel when triggered by a current flow into or out of a gate terminal. Once triggered, the device continues to conduct until the current drops below a certain threshold known as the holding current.

TRIACs are capable of controlling large current flow with milliamp-scale gate currents. For AC power control applications, current flow through a TRIAC can be varied by applying a trigger pulse to the TRIAC gate at a controlled phase angle during each AC half cycle. TRIACs are commonly used in low-power motors speed control, lamp dimming, controlling current flow through AC heating resistive elements, etc.

A TRIAC may also be used for current control in DC power applications. In a typical case, the output waveform of a half or full wave rectifier is modulated by a TRIAC firing in response to a phase controlled trigger pulse. Dimming control of LED lighting may employ such techniques. One method of obtaining an analog brightness signal is to apply an analog filter to the waveform chopped by the TRIAC. A digital power controller for lighting dimmers may digitally time sample a rising edge dimmer phase angle by capturing a sharp rising transition within the rectified AC waveform relative to the immediately preceding falling edge. Digital time sampling of a trailing edge dimmer phase angle captures a sharp falling transition relative to the immediately preceding rising edge. Thus, one of two methods is used depending upon the dimmer type, leading edge or falling edge.

SUMMARY OF THE INVENTION

Embodiments and methods herein digitally time-sample a waveform associated with a rectified AC, edge-controlled power signal to generate a dimming (DIM) code. A DIM code is a digital value suitable for input to a DAC to generate an analog brightness signal proportional to the DIM code. Embodiments of the invention generate a DIM code normalized with respect to an allowable edge control window synchronized with the waveform. Such normalization results in a DIM code corresponding to a full scale DAC output (maximum brightness) from a waveform minimally dimmed with respect to an allowable dimming window. Likewise, a DIM code of zero corresponding to minimum brightness is generated upon receiving a waveform that is maximally dimmed within the allowable dimming window. In other words, dimming increases inversely with increases in the DIM code.

In the case of a leading-edge controlled dimmer, falling edge zero crossings correspond to the rectified AC sine wave zero crossing and rising edge zero crossings correspond to the phase angle associated with the TRIAC trigger. The opposite set of zero crossings apply in the case of a trailing edge dimmer. Methods herein are implemented using timing based upon leading and falling edges rather than being based upon TRIAC triggering points per se. These methods are thus equally applicable to leading-edge and trailing-edge dimmer waveforms without knowing the dimmer type, as further described below.

Digital measurements in the form of counts at a first clock rate F1 are taken to determine the period between the leftmost edge of the allowable control window (corresponding to the earliest allowable time within the control window, as further described below) and the next rising edge zero crossing. DIM codes are generated from these measurements.

DETAILED DESCRIPTION

Figure 1:
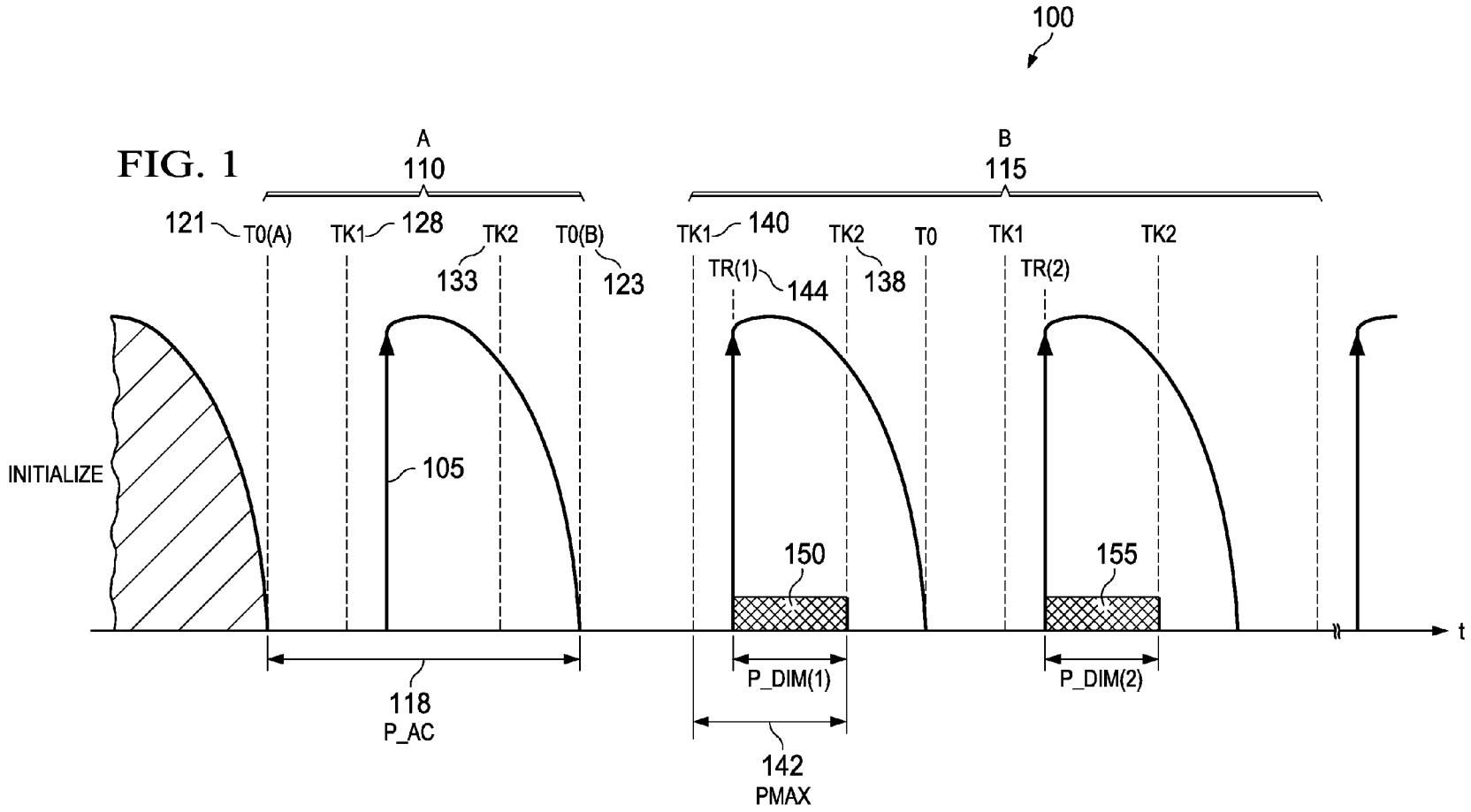
FIG. 1 is a diagram of a waveform associated with a full-wave rectified, leading edge controlled dimmer signal according to various example embodiments of the invention.

FIG. 1 is a diagram of a waveform 100 associated with a full-wave rectified, leading edge controlled dimmer signal according to various example embodiments of the invention. The TRIAC trigger point 105 is considered only in so far as it is a rising edge apparatus and methods herein treat a rising edge in the same manner whether or not the rising edge corresponds to a trigger point. The waveform 100 is divided into a section A 110 and a section B 115. Synchronization measurements are performed on section A 110 of the waveform 100. Measurements are performed on section B 115 to generate one or more DIM codes.

The period P_AC 118 of the waveform 100 is determined by counting at a first clock rate F1 from the falling edge T0(A) 121 to the subsequent falling edge T0(B) 123 to obtain a count CP corresponding to the period P_AC 118. A selected control window is defined between time TK1 128 and time TK2 133 by selecting K1 and K2 as percentages of the period P_AC 118.

A normalized clock rate F2 is calculated such that a count at the normalized clock rate F2 starting at time TK1 140 and stopping at time TK2 138 is equal to a full-scale count CMAX of a DAC used to convert a DIM code to a brightness signal. The period PMAX 142 corresponds to the count CMAX. It is noted that a DIM code of CMAX represents no dimming or maximum brightness, given that the rising edge of the waveform occurs at or prior to the time TK1 140. In this sense, "DIM code" may be something of a misnomer because brightness increases positively as the DIM code increases positively, as previously mentioned.

A counter is loaded with the full-scale count CMAX. Starting at time TK1 140, the counter counts down at the normalized clock rate F2 and stops when the next rising edge TR(1) 144 is detected. The remaining content of the counter is the DIM code 150 corresponding to the period P_DIM(1). In other words, by loading the counter with the full count CMAX corresponding to PMAX 142 and then subtracting the count corresponding to the time between TK1 140 and TR(1) 144, the DIM code corresponding to the period P_DIM(1) remains. Some embodiments may average DIM codes measured across subsequent cycles (e.g., the DIM code DIM(2) 155 corresponding to the period P_DIM(2)). Doing so may result in a more accurate DIM code, referred to herein as the "conversion DIM code." The conversion DIM code is then converted to an analog brightness signal. It is noted that, although the rising edge TR(1) 144 of the leading edge dimmer case of FIG. 1 corresponds to a TRIAC trigger, this need not be the case as previously mentioned and as further explained below.

Figure 2:
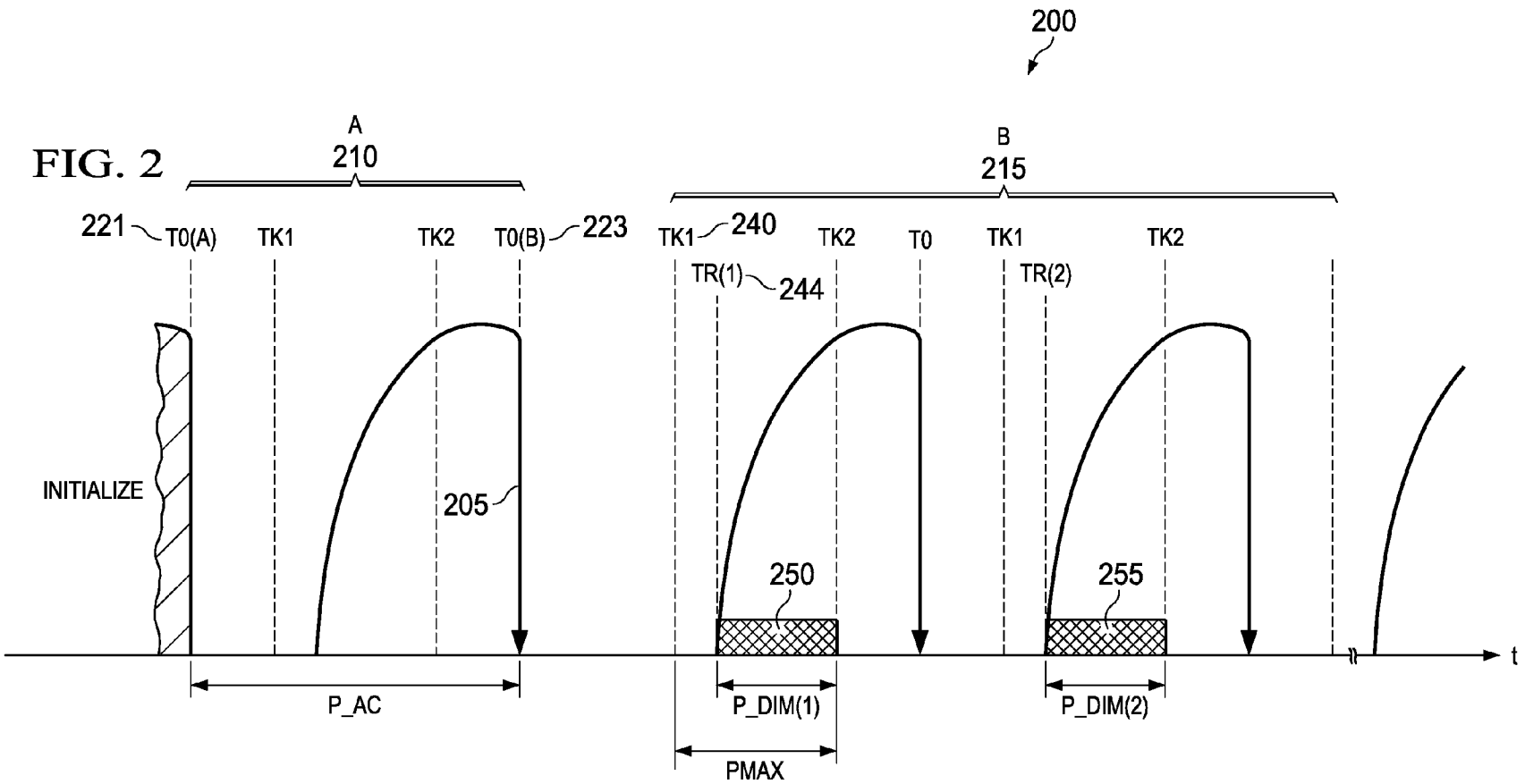
FIG. 2 is a diagram of a waveform associated with a full-wave rectified, trailing edge controlled dimmer signal according to various example embodiments.

FIG. 2 is a diagram of a waveform 200 associated with a full-wave rectified, trailing edge controlled dimmer signal according to various example embodiments. Methods and apparatus herein operate on the trailing edge controlled dimmer signal of FIG. 2 in the same way as previously described with reference to the leading-edge controlled dimmer case of FIG. 1. Although falling edge 205 corresponds to the TRIAC trigger point, measurements are made with reference to falling edges, rising edges, and K1 percentages of the waveform period P_AC without regard to the time of TRIAC triggering.

Thus, a count CP corresponding to the waveform period P_AC is obtained by counting at a first frequency from the falling edge T0(A) 221 to the next falling edge T0(B) 223. The DIM code 250 corresponding to the period P_DIM(1) for a particular cycle is obtained by subtracting a count taken at a normalized clock rate F2 between the times TK1 240 and TR(1) 244 from the full-scale count CMAX corresponding to the period of the allowable dimming window period PMAX.

Figure 3:
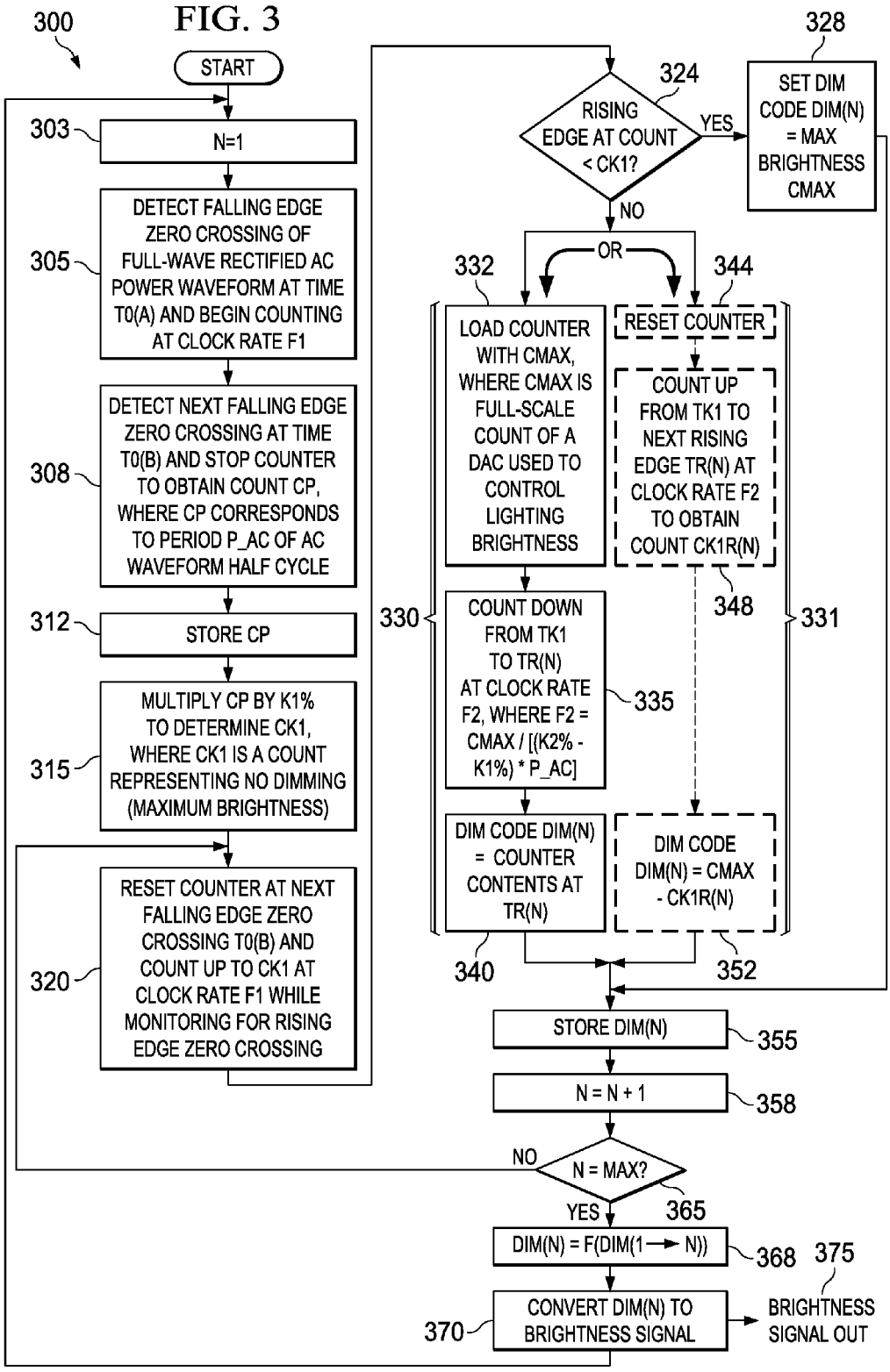
FIG. 3 is a flow diagram representing a method of generating a normalized digital representation of the magnitude of a brightness signal by digitally processing a waveform associated with a full wave rectified, edge-controlled dimmer signal according to various example sequences.

FIG. 3 is a flow diagram representing a method 300. Sequencing through the method 300 results in a normalized digital representation of the magnitude of a brightness signal by digitally processing a waveform associated with a full wave rectified, edge-controlled dimmer signal according to various example sequences.

Activities associated with the method 300 are summarized as follows. A waveform associated with an edge modulated AC power signal is received. A time domain width and position of an allowable edge control window relative to and synchronous with the waveform is established. A clock rate F2 normalized with respect to the width of the allowable edge control window is established such that a count CMAX of the width at the normalized clock rate F2 corresponds to a full-scale analog output of a DAC used to control lighting brightness. Finally, a count is accrued at the normalized clock rate F2 to capture a DIM code normalized to the full-scale DAC output. The count is started at an earliest time corresponding to the allowable edge control window and stopped at a next rising edge zero crossing.

In detail, and with reference to FIG. 3, the method 300 begins at block 303 with initializing an index N representing a number of DIM code samples to process before performing a next synchronization sequence. The method 300 continues with a synchronization sequence starting at block 305, including counting at a first clock rate F1 upon detecting a first falling edge zero crossing associated with the waveform. The synchronization sequence continues at block 308 with stopping the counting upon detecting an immediately subsequent falling edge zero crossing associated with the waveform. The synchronization sequence also includes storing a content of the counter as a count CP corresponding to a period P_AC of the waveform, at block 312. The synchronization sequence completes at block 315 by multiplying the count CP by a selected constant percentage K1%. The result is a count CK1 corresponding to the earliest starting time of the allowable edge control window following an immediately prior falling edge zero crossing.

The method 300 continues with resetting the counter at the next falling edge zero crossing T0(B) and counting up to CK1 at the first clock rate F1, at block 320. The method 300 also includes determining whether a rising edge is encountered before reaching the count CK1, at block 324. If so, the method 300 includes setting a currently-indexed DIM code DIM(N) equal to CMAX, where CMAX is the maximum count associated with the DAC and represents maximum brightness, at block 328. The method 300 also includes storing DIM(N) at block 355 and incrementing N at block 358 if the condition of block 324 is satisfied.

If the condition at block 324 is not satisfied, the method 300 includes calculating a normalized clock rate F2 as CMAX/[(K2%−K1%)*P_AC]. The selected constant K2% represents the upper bound of the maximum allowable edge control window as a percentage of the period P_AC of the waveform. In other words, K2% is the percentage of the waveform period P_AC representing minimum brightness.

The method 300 may follow a sequence 330 or an optional sequence 331. In the first case, the method 300 may proceed at block 332 with loading the counter with count CMAX. The method 300 may also include counting down at the normalized clock rate F2 beginning at time TK1 corresponding to the count CK1 and stopping the count at a next rising edge zero crossing, at block 335. The DIM code DIM(N) is set equal to the counter content at block 340.

As mentioned, the method 300 may follow the optional sequence 331 as an alternative to the sequence 330 described immediately above. In that case, the method 300 includes resetting the counter at block 344. The method 300 also includes counting up from time TK1 at the normalized clock rate F2 and stopping the count at a next rising edge zero crossing to obtain an intermediate count CK1R(N), at block 348. The optional sequence 331 finishes at block 352 with calculating the DIM code DIM(N) as equal to CMAX−CK1R(N).

Following either the sequence 330 or the sequence 331, the method 300 continues at block 355 with storing the immediately previously determined DIM code DIM(N) and incrementing the index N at block 358. The method 300 also includes determining whether the index N has reached a selected maximum value, at block 365. If not, the method 300 continues at block 320 with capturing an additional DIM code.

If the index N has reached the selected maximum value, the method 300 proceeds at block 368 with performing a mathematical function F(DIM(1→N)) on stored DIM codes to obtain a convertible DIM code. In some sequences, the mathematical function F(DIM(1→N)) may be a simple averaging of the stored DIM codes. Some versions of the method 300 may use other averaging techniques such as the square root of the sum of the squares of DIM codes, etc. in order to filter out variations in DIM codes. The method 300 also includes converting the convertible DIM code to a brightness signal (e.g., using the DAC), at block 370 to obtain an analog brightness output signal 375. The method 300 may continue with reinitializing the index N at block 303, re-synchronizing at blocks 305 through 315, and capturing a new set of DIM codes at blocks 320 through 358.

Figure 4:
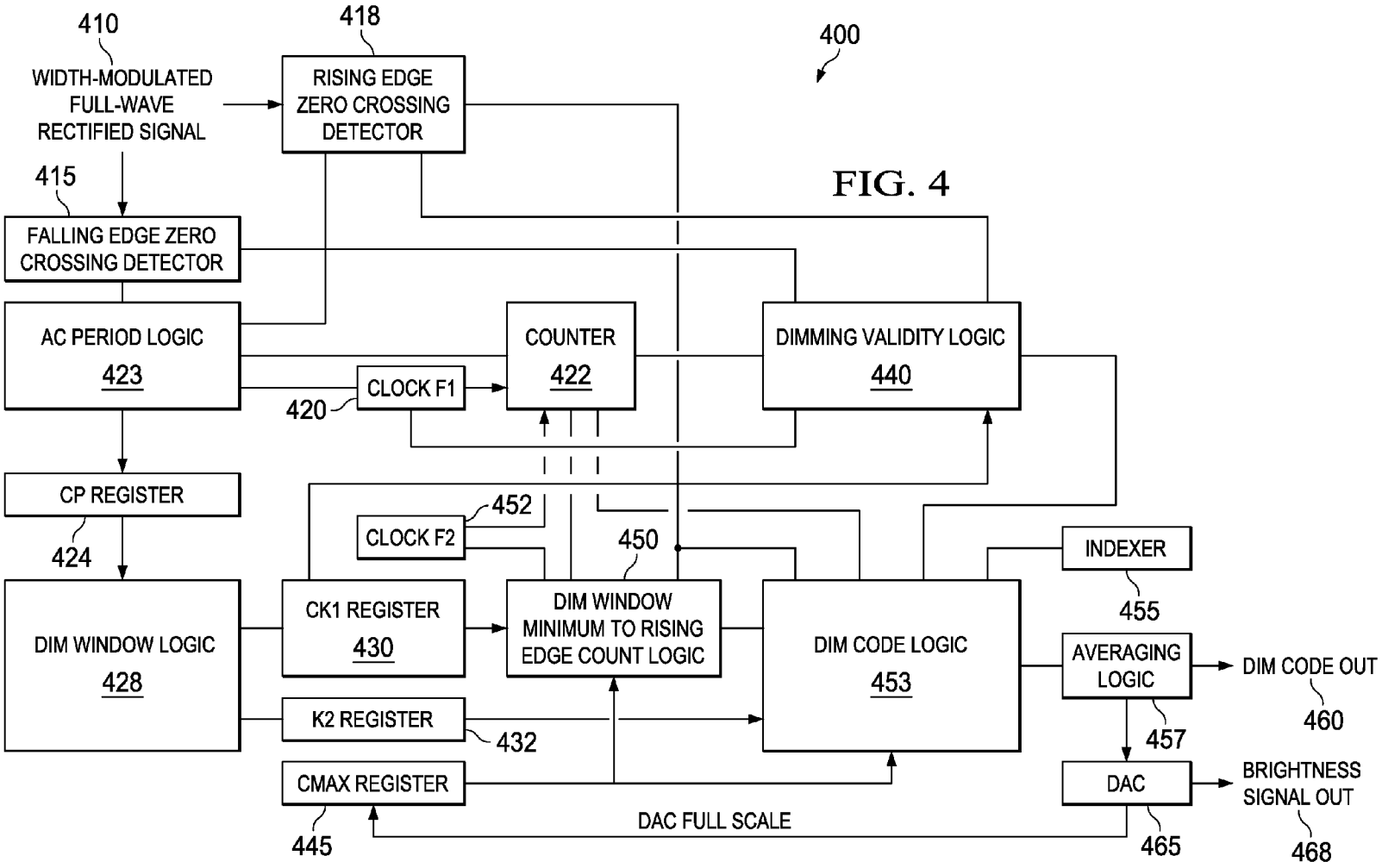
FIG. 4 is a block diagram of an apparatus capable of generating a normalized digital representation of the magnitude of a brightness signal by digitally processing a waveform associated with a full wave rectified, edge-controlled dimmer signal according to various example embodiments.

FIG. 4 is a block diagram of an apparatus 400 capable of generating a normalized digital representation of the magnitude of a brightness signal. The apparatus 400 operates by digitally processing a waveform associated with a full wave rectified, edge-controlled dimmer signal according to various example embodiments.

The structure of the apparatus 400 is summarized as follows. Synchronization logic receives the waveform, measures the half-cycle period, and establishes a time domain width and position of an allowable edge control window relative to and synchronous with the waveform. Clock rate normalization logic determines a clock rate F2 normalized with respect to the width of the allowable edge control window such that a count CMAX of the width at the normalized clock rate F2 corresponds to a full-scale analog output of a DAC used to control lighting brightness. DIM code capture logic captures a DIM code normalized to the full-scale DAC output by counting at the normalized clock rate F2 from an earliest time corresponding to the allowable edge control window to the next rising edge zero crossing.

In detail, and with reference to FIG. 4 in light of FIGS. 1 and 2, the apparatus 400 includes a falling edge zero crossing detector 415 to detect a falling edge of the waveform 410. The apparatus 400 also includes a rising edge zero crossing detector 418 to detect a rising edge of the waveform. The apparatus 400 further includes a first clock 420 operating at a first frequency F1. A counter 422 is communicatively coupled to the first clock 420.

The apparatus 400 includes AC period logic 423 communicatively coupled to the counter 422, to the falling edge zero crossing detector 415, and to the rising edge zero crossing detector 418. The AC period logic 423 counts up at the first frequency F1 from a first falling edge of the waveform (e.g., the falling edge 121 of FIG. 1) to a subsequent falling edge of the waveform (e.g. the falling edge 123) to determine a count CP corresponding to a half-cycle period P_AC of the waveform. The apparatus 400 also includes a CP register 424 communicatively coupled to the AC period logic 423. The CP register 424 stores the count CP.

The apparatus 400 includes DIM window logic 428 communicatively coupled to the CP register 424. The dim window logic 428 multiplies the count CP by a constant percentage value K1% to determine a count CK1. The count CK1 correspondence to the earliest starting time of the allowable edge control window (e.g., the control window PMAX 142 of FIG. 1) following an immediately prior falling edge zero crossing. The apparatus 400 also includes a CK1 register 430 communicatively coupled to the DIM window logic 428 to store the count CK1. The apparatus 400 further includes a K2 register 432 communicatively coupled to the DIM window logic 428. The K2 register 432 stores a selected constant K2%. K2% represents the upper bound of the maximum allowable edge control window as a percentage of the period P_AC of the waveform. The time TK2 138 of FIG. 1 corresponds to K2% and represents maximum dimming (minimum brightness).

The apparatus 400 includes a CMAX register 445 to store the count CMAX corresponding to the full-scale analog output of a DAC used to control lighting brightness. The apparatus 400 also includes dimming validity logic 440 communicatively coupled to the counter 422. The dimming validity logic 440 resets the counter 422 at the next falling edge zero crossing and then counts up to the count CK1 at the first clock rate F1. If a rising edge is encountered before reaching the count CK1, the dimming validity logic 440 causes a currently-indexed DIM code DIM(N) to be set equal to CMAX.

The apparatus 400 includes a second clock 452 communicatively coupled to the counter 422. The second clock 452 operates at the normalized clock rate F2, where F2=CMAX/[(K2%−K1%)*P_AC].

The apparatus 400 also includes dim window minimum to rising edge count logic 450 communicatively coupled to the CK1 register 430. The dim window minimum to rising edge count logic 450 loads the counter 422 with count CMAX. The logic 450 then counts down at the normalized clock rate F2 from a time TK1 corresponding to the count CK1 to the time of occurrence of the next rising edge TR(N) to obtain a DIM code DIM(N). In an alternate embodiment, the dim window minimum to rising edge count logic 450 may reset the counter and then count up at the normalized clock rate F2 from the time TK1 to the next rising edge zero crossing to obtain an intermediate count CK1R(N).

Dim code logic 453 is communicatively coupled to the dim window minimum to rising edge count logic 450 and to the dimming validity logic 440. The DIM code logic 453 sets the DIM code DIM(N) according to previous operations and stores DIM(N). In the case of the dimming validity logic 440 encountering a rising edge prior to the start of the valid dim window (e.g., time TK1 140 of FIG. 1), the DIM code logic 453 sets the current DIM code DIM(N) equal to the full-scale DAC load value CMAX. In the case of the first-described implementation of the dim window minimum to rising edge count logic 450, the DIM code logic 453 sets DIM(N) equal to the counter content. In the case of the alternate embodiment of the dim window minimum to rising edge count logic 450, the DIM code logic 453 sets DIM(N) equal to (CMAX−CK1R(N)).

The apparatus 400 may also include an indexer 455 communicatively coupled to the DIM code logic 453. The indexer 455 increments N and determines if N has reached a selected maximum value. If not, logic blocks 440, 450, and 453 are repeatedly exercised to create additional DIM code values.

The apparatus 400 may also include averaging logic 457 communicatively coupled to the DIM code logic 453. If N has reached the selected maximum value, the averaging logic 457 performs a mathematical function F(DIM(1→N)) on the stored DIM codes to obtain a convertible DIM code 460. In some embodiments, F(DIM(1→N)) may be a simple average of the stored DIM codes. The averaging logic 457 then outputs the convertible DIM code 460 to a DAC 465 for conversion to an analog brightness signal 468.

Modules and components described herein may include hardware circuitry, optical components, single or multi-processor circuits, memory circuits and/or computer-readable media with computer instructions encoded therein/thereon capable of being executed by a processor, including non-volatile memory with firmware stored therein, but excluding non-functional descriptive matter, and combinations thereof, as desired by the architects of the method 300 and the apparatus 400 and as appropriate for particular implementations of various embodiments.

Apparatus and systems described herein may be useful in applications other than generating a DIM code normalized to an allowable dimming window in a lighting power controller. Other applications may exist for the described methods and apparatus. Examples of the method 300 and the apparatus 400 are intended to provide a general understanding of the flow of various sequences and the structures of various embodiments. They are not intended to serve as complete descriptions of all elements and features of apparatus and systems that might make use of these sequences and structures.

The various embodiments may be incorporated into electronic circuitry used in lighting control systems, computers, communication and signal processing circuitry, single-processor or multi-processor modules, single or multiple embedded processors, multi-core processors, data switches, and application-specific modules including multi-layer, multichip modules, among others. Such apparatus and systems may further be included as sub-components within a variety of electronic systems, such as televisions, cellular telephones, personal computers (e.g., laptop computers, desktop computers, handheld computers, tablet computers, etc.), workstations, radios, video players, audio players (e.g., MP3 (Motion Picture Experts Group, Audio Layer 3) players), vehicles, medical devices (e.g., heart monitor, blood pressure monitor, etc.), set top boxes, and others.

Apparatus and methods described herein perform digital time sampling of a waveform associated with a rectified AC, edge-controlled power signal, whether leading or trailing edge controlled. A DIM code normalized with respect to an allowable edge control window is generated based upon the time sampling. The DIM code is loaded into a DAC to be converted to an analog brightness signal. The analog brightness signal may be used by a lighting power controller to control the brightness of one or more lighting elements. Accurate and repeatable light intensities independent of dimmer type, whether leading or trailing edge, may result.

By way of illustration and not of limitation, the accompanying figures show specific embodiments in which the subject matter may be practiced. It is noted that arrows at one or both ends of connecting lines are intended to show the general direction of electrical current flow, data flow, logic flow, etc. Connector line arrows are not intended to limit such flows to a particular direction such as to preclude any flow in an opposite direction. The embodiments illustrated are described in sufficient detail to enable those skilled in the art to practice the teachings disclosed herein. Other embodiments may be used and derived therefrom, such that structural and logical substitutions and changes may be made without departing from the scope of this disclosure. This Detailed Description, therefore, is not to be taken in a limiting sense. The breadth of various embodiments is defined by the appended claims and the full range of equivalents to which such claims are entitled.

Such embodiments of the inventive subject matter may be referred to herein individually or collectively by the term "invention" merely for convenience and without intending to voluntarily limit this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments.

The Abstract of the Disclosure is provided to comply with 37 C.F.R. §1.72(b) requiring an abstract that will allow the reader to quickly ascertain the nature of the technical disclosure. It is submitted with the understanding that it will not be used to interpret or limit the scope or meaning of the claims. In the preceding Detailed Description, various features are grouped together in a single embodiment for the purpose of streamlining the disclosure. This method of disclosure is not to be interpreted to require more features than are expressly recited in each claim. Rather, inventive subject matter may be found in less than all features of a single disclosed embodiment. The following claims are hereby incorporated into the Detailed Description, with each claim standing on its own as a separate embodiment.

What is claimed is:

1. A signal processing method, comprising:

receiving a waveform associated with an edge modulated, rectified alternating current (AC) power signal;

establishing a time domain width and position of an allowable edge control window relative to and synchronous with the waveform;

determining a clock rate F2 normalized with respect to the width of the allowable edge control window such that a count CMAX of the width at the normalized clock rate F2 corresponds to a full-scale analog output of a digital-to-analog converter (DAC) used to control lighting brightness; and counting from an earliest time corresponding to the allowable edge control window to a next rising edge zero crossing at the normalized clock rate to capture a dimming (DIM) code normalized to the full-scale DAC output, the DIM code proportional to a level of dimming associated with the waveform.

2. The signal processing method of claim 1, further comprising:

initializing an index N representing a number of DIM code samples to process before performing a next synchronization sequence.

3. The signal processing method of claim 1, further including a synchronization sequence comprising:

at a counter, counting at a first clock rate upon detecting a first falling edge zero crossing associated with the waveform;

stopping the counting upon detecting an immediately subsequent falling edge zero crossing associated with the waveform;

storing a content of the counter as a count CP corresponding to a period P_AC of the waveform; and multiplying the count CP by a selected constant percentage K1% to determine a count CK1 corresponding to the earliest starting time of the allowable edge control window following an immediately prior falling edge zero crossing.

4. The signal processing method of claim 3, further comprising:

resetting the counter at the next falling edge zero crossing; and counting up to the count CK1 at the first clock rate.

5. The signal processing method of claim 4, including conditional activities to be performed if a rising edge is encountered before reaching the count CK1, the conditional activities comprising:

setting a currently-indexed DIM code DIM(N) equal to CMAX;

storing DIM(N); and incrementing N.

6. The signal processing method of claim 4, further comprising:

calculating the normalized clock rate F2 as CMAX/[(K2%−K1%)*P_AC], selected constant K2% representing the upper bound of the maximum allowable edge control window as a percentage of the period P_AC of the waveform.

7. The signal processing method of claim 6, including conditional activities to be performed if no rising edge is encountered before reaching the count CK1, the conditional activities comprising:

resetting the counter;

counting up from time TK1 at the normalized clock rate;

stopping the count at a next rising edge zero crossing to obtain an intermediate count CK1R(N);

calculating DIM(N) as CMAX minus CK1 R(N);

storing DIM(N); and incrementing N.

8. The signal processing method of claim 6, including conditional activities to be performed if no rising edge is encountered before reaching the count CK1, the conditional activities comprising:

loading the counter with count CMAX;

beginning at time TK1 corresponding to the count CK1, counting down at the normalized clock rate F2;

stopping the count at a next rising edge zero crossing, the count equal to the DIM code DIM(N);

storing DIM(N); and incrementing N.

9. The signal processing method of claim 8, further comprising:

determining whether the index N has reached a selected maximum value; and capturing an additional DIM code if N has not reached the selected maximum value.

10. The signal processing method of claim 9, including conditional activities to be performed if the index N has reached the selected maximum value, the conditional activities comprising:

performing a mathematical function F(DIM(1→N)) on stored DIM codes to obtain a convertible DIM code if N has reached the selected maximum value; and converting the convertible DIM code to an analog brightness value.

11. The signal processing method of claim 10, further comprising:

re-initializing the index N before performing a next synchronization sequence if N has reached the selected maximum value.

12. An apparatus, comprising:

synchronization logic to receive a waveform associated with an edge modulated, rectified alternating current (AC) power signal and to establish a time domain width and position of an allowable edge control window relative to and synchronous with the waveform;

clock rate normalization logic communicatively coupled to the synchronization logic to determine a clock rate normalized with respect to the width of the allowable edge control window such that a count CMAX of the width at the normalized clock rate corresponds to a full-scale analog output of a digital-to-analog converter (DAC) used to control lighting brightness; and dimming (DIM) code capture logic communicatively coupled to the clock rate normalization logic to count from an earliest time corresponding to the allowable edge control window to the next rising edge zero crossing at the normalized clock rate to capture a DIM code normalized to the full-scale DAC output, the DIM code proportional to a level of dimming associated with the waveform.

13. The apparatus of claim 12, further comprising:

a falling edge zero crossing detector to detect a falling edge of the waveform; and a rising edge zero crossing detector to detect a rising edge of the waveform.

14. The apparatus of claim 13, further comprising:

a first clock operating at a first frequency F1;

a counter coupled to the first clock;

AC period logic communicatively coupled to the counter, to the falling edge zero crossing detector, and to the rising edge zero crossing detector to count up at the first frequency F1 from a first falling edge of the waveform to a subsequent falling edge of the waveform to determine a count CP corresponding to a half-cycle period of the waveform P_AC; and a CP register communicatively coupled to the AC period logic to store the count CP.

15. The apparatus of claim 14, further comprising:

DIM window logic communicatively coupled to the CP register to multiply the count CP by a constant percentage value K1% to yield a count CK1 corresponding to the earliest starting time of the allowable edge control window following an immediately prior falling edge zero crossing;

a CK1 register communicatively coupled to the DIM window logic to store the count CK1; and a K2 register communicatively coupled to the DIM window logic to store a selected constant K2% representing the upper bound of the maximum allowable edge control window as a percentage of the period P_AC of the waveform.

16. The apparatus of claim 15, further comprising:

a CMAX register to store the count CMAX corresponding to the full-scale analog output of the DAC used to control lighting brightness;

dimming validity logic communicatively coupled to the counter to reset the counter at the next falling edge zero crossing, to count up to the count CK1 at the first clock rate, and to cause a currently-indexed DIM code DIM (N) to be set equal to CMAX if a rising edge is encountered before reaching the count CK1; and a second clock communicatively coupled to the counter and operating at the normalized clock rate F2, F2 equal to CMAX/[(K2%−K1%)*P_AC].

17. The apparatus of claim 16, further comprising:

dim window minimum to rising edge count logic communicatively coupled to the CK1 register to load the counter with count CMAX, to count down at the normalized clock rate F2 from a time TK1 corresponding to the count CK1 to the time of occurrence of the next rising edge TR(N); and DIM code logic communicatively coupled to the dim window minimum to rising edge count logic to set the DIM code equal to the counter content and to store the DIM code DIM(N).

18. The apparatus of claim 17, further comprising:

dim window minimum to rising edge count logic communicatively coupled to the counter to reset the counter, to count up at the normalized clock rate F2 from the time TK1, to stop the count at a next rising edge zero crossing to obtain an intermediate count CK1R(N); and DIM code logic communicatively coupled to the dim window minimum to rising edge count logic to calculate DIM(N) as CMAX minus CK1R(N) and to store DIM (N).

19. The apparatus of claim 18, further comprising:

an indexer communicatively coupled to the DIM code logic to increment N and to determine when N has reached a selected maximum value; and averaging logic communicatively coupled to DIM code logic to perform a mathematical function F(DIM (1→N)) on stored DIM codes to obtain a convertible DIM code if N has reached the selected maximum value and to output the convertible DIM code to the DAC for conversion to an analog brightness signal.

20. A method, comprising:

receiving a waveform associated with an edge modulated, rectified alternating current (AC) power signal of half-wave period P_AC;

establishing a time domain width and position of an allowable edge control window relative to and synchronous with the waveform;

calculating a clock rate F2 normalized with respect to the width of the allowable edge control window as CMAX/[(K2%−K1%)*P_AC], selected constants K1% and K2% representing lower and upper bounds, respectively, of the maximum allowable edge control window as percentages of P_AC such that CMAX corresponds to a full-scale analog output of a digital-to-analog converter (DAC) used to control lighting brightness; and counting from an earliest time corresponding to the allowable edge control window to a next rising edge zero crossing at the normalized clock rate to capture a dimming (DIM) code normalized to the full-scale DAC output.

* * * * *